US007770493B2

(12) United States Patent
Wyatt, Sr.

(10) Patent No.: US 7,770,493 B2
(45) Date of Patent: Aug. 10, 2010

(54) BOLT AND SCREW HOLDING TOOL TO AIDE IN ASSEMBLY OR DISASSEMBLY PROCESS

(75) Inventor: Glen Earl Wyatt, Sr., Vallejo, CA (US)

(73) Assignee: Glen Wyatt, Sr., Vallejo, CA (US)

( * ) Notice: Subject to any disclaimer, the term of this patent is extended or adjusted under 35 U.S.C. 154(b) by 0 days.

(21) Appl. No.: 11/787,817

(22) Filed: Apr. 18, 2007

(65) Prior Publication Data

US 2008/0257114 A1 Oct. 23, 2008

(51) Int. Cl.
*B25C 3/00* (2006.01)
*B25B 9/00* (2006.01)

(52) U.S. Cl. ..... 81/44; 81/13

(58) Field of Classification Search ..... 81/44, 81/13, 55

See application file for complete search history.

(56) References Cited

U.S. PATENT DOCUMENTS

| | | | | | |
|---|---|---|---|---|---|
| 1,724,435 | A | * | 8/1929 | Studwell | 294/19.1 |
| 1,867,928 | A | * | 7/1932 | Smith | 81/44 |
| 2,191,010 | A | * | 2/1940 | Dahlquist | 81/44 |
| 3,326,254 | A | * | 6/1967 | Diehl | 81/44 |
| 3,960,356 | A | * | 6/1976 | Adams | 249/205 |
| 4,056,301 | A | * | 11/1977 | Norden | 439/724 |
| 4,641,478 | A | * | 2/1987 | Nelson, Jr. | 52/704 |

* cited by examiner

*Primary Examiner*—Hadi Shakeri

(57) ABSTRACT

An assembly of punched and formed material that has an ergonomically designed hood which covers a torsion spring that connects the hood to the formed and punched hook and a sliding base. The base and hood thereof is inserted and secured to the hook which allows the base to slide as the hood assembly is being pinched which opens the hook and allows the tool to be placed onto the threads of bolts, screws, or small pipe.

2 Claims, 5 Drawing Sheets

BOLT AND SCREW HOLDING TOOL TO AIDE IN ASSEMBLY OR DISASSEMBLY PROCESS

FIELD OF INVENTION

This invention is related to and gives the assistance in work having the use of bolts and screws having to attach washers and nuts.

BACKGROUND OF INVENTION

When assembling various types of equipment like, exercise and various gym machines, large and small lockers and cabinets, computer boards, decks, automobile repairs, garage doors and openers, plumbing, overhead industrial work which includes installing transformers and cross arms on telephone poles, installation of light fixtures, ceiling fans, street signs etc. Most of these jobs requires a person to have a third hand to hold a bolt or bolts in place for assembly purposes while the other hand puts on the washers and nuts. Some will attempt the work without asking for assistance only to get frustrated and sore from dropping the hardware and or from hyper-extending their arms to reach the washers and nuts to the bolts. When working overhead, often times some of the hardware falls to the ground and a person would have to go up and down their ladder to retrieve the hardware. Many times while one hand holds the bolt or screw in place, the other hand has to keep the piece being assemble together. While at the same time, holding the washers and nuts, a person then has to coordinate their fingers to grasp the washers and nuts to install them. This method of assembly can be very painful to the hands; especially when there are several washers and nuts (now referred to as hardware) to be installed.

Very often a second person is needed for the purpose of holding the bolt and items being assembled in place while the other person installs the hardware. The second person is sometimes hard to find and in industrial applications, can be costly. Some people have attempted to use locking pliers which damages the threads. Others have used standard screwdrivers to hold a bolt in place while attaching the hardware; which too can damage threads.

SUMMARY OF INVENTION

The bolt backer invention is a bolt/screw holding tool. It has a soft hood to comfort the pinch grip pressure needed to open the hook which holds the bolt/screws. When the open hook is placed on a bolt/screw, it creates a three point contact onto the threads of the bolt/screw when the hood pressure is released. The bolt is now locked. Under the hood is a torsion spring that closes the hook sliding system into the v-cut at the tip of the base which locks the bolt or screw and holds it in place. The v-cut at the tip of the base has a beveled edge. With the thin hook material, they fit between the treads of most size bolts and screws, limiting the slipping thereof. The extension between the v-cut and the first guide provides a very thin space to slip between tight tolerances of hardware and material. This thin space is crucial when working with carriage bolts, getting them to set in position. The round cut in the first guide at the tip of the base is to allow space for the washers; so they will not interfere with the working distance on the bolt. The space between the first guide and the second guide is the flex shaft. The flex shaft allows the tool to bend when working in tight or odd angles. In it's resting position, the sliding hook is set at the back edge of the v-cut; not showing any open area. This allows the tool to be used on very small screws and bolts.

DETAILED DESCRIPTION OF THE INVENTION

Figure 1:
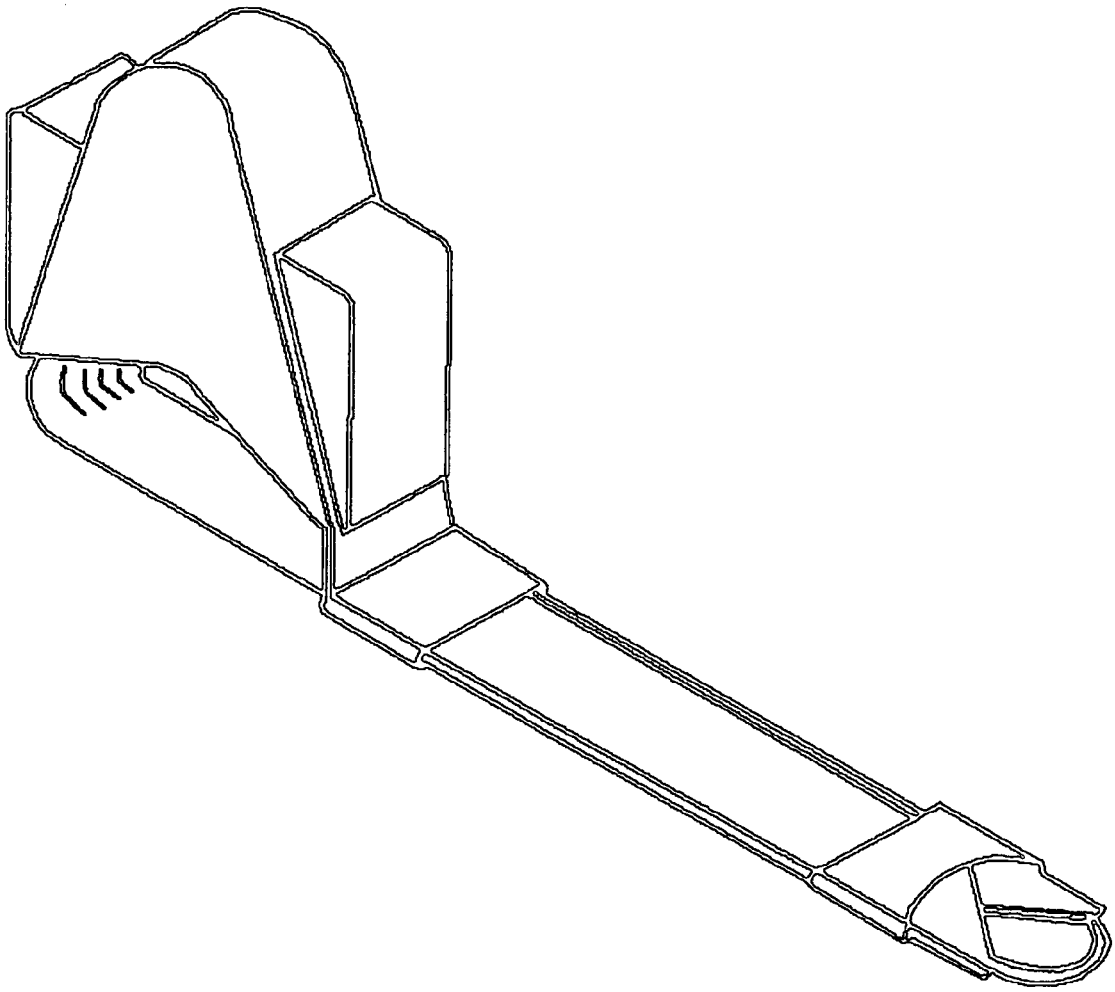
FIG. 1 is a perspective of the complete assembled drawing of the tool invention.

FIG. 1 is a perspective drawing of the complete invention in it's fully assembled state. The ergonomic hood 1 has ergonomic pads 5 to alleviate soft tissue compression, a protective sleeve 8 that covers a guide, which allows said ergonomic hood to attach over and onto triangular bend in hook bar 2. The hood 1 is formed of, non limiting example and can be any other material, soft rubber material which has three purposes; A) To form a safety barrier between the assembled parts and a person's hand B) It has internal assembly points to the unit and C) Forms a protective sleeve over the second anchor guide 26 which may have a sharp edges. When the ergonomic pads 5 is squeezed or pinched, the bend 9 with the triangular bends in the hook bar 2 allows the sliding anchor base 4 to move, opening the hook latch 17 allowing the v-cut notch 19 to be placed on a bolt or screw while the sliding anchor base guide 23 holds the hook latch in place.

Figure 2A:
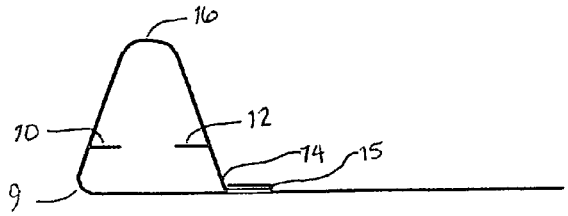
FIGS. 2-2C are views of the hook bar.
Figure 2:
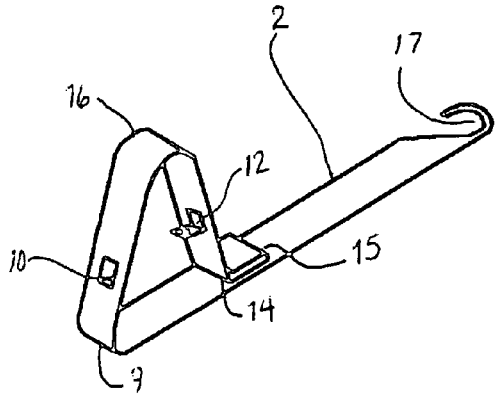
Figure 2B:
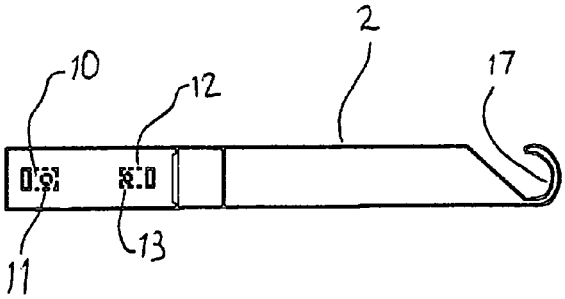
Figure 2C:
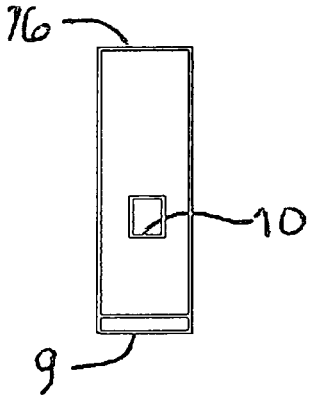

FIGS. 2-2C illustrate the hook bar 2 with three sided gusset punches 10 having holes 11 and bends details 9, 14, 15, and 16 none limiting to example made of spring steel. The hook latch 17 is an oval punch which is angled on the end of the hook bar 2. The bends define a triangular shape rear portion comprising of a first bend 9 that is over 90 degrees bending back towards the hook latch 17. 16 is the top bend on the hook bar which is approximately 315 degrees. Bend 14 is the resting place for the sliding anchor base guide 26 and bend 15 is folded over when guide 26 of the sliding anchor base 4 is in place. The three sided gusset punch holes 11 are the assembly holes for the stab ends 18 of the torsion spring 3 that slides into holes 7 of tab 6 of the ergonomic hood locking the hood in place.

Figure 3:
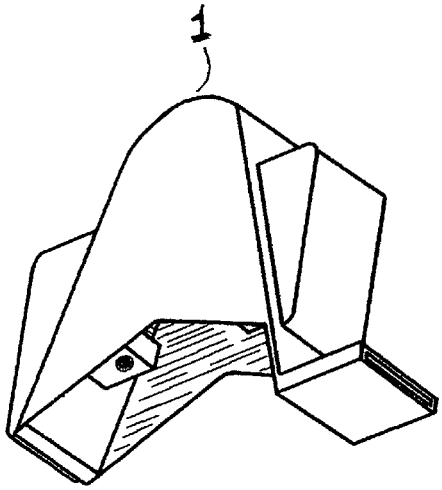
FIGS. 3-3C are views of the ergonomic hood.
Figure 3A:
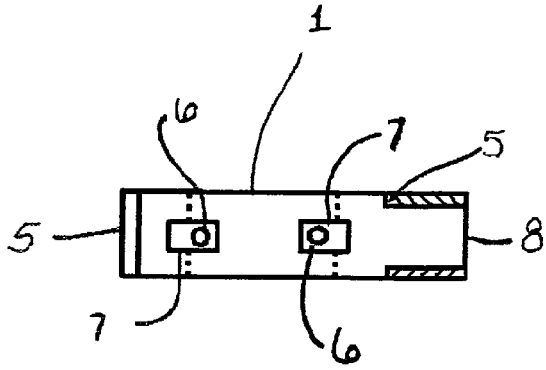
Figure 3B:
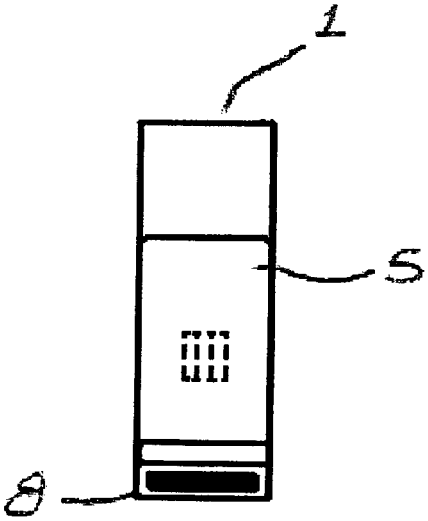
Figure 3C:
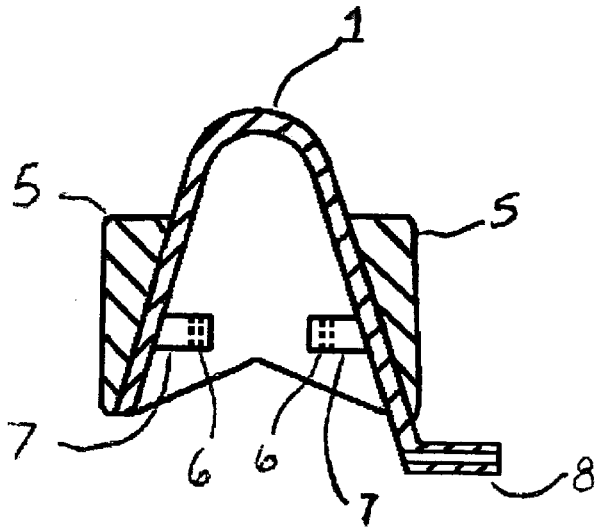

FIGS. 3-3C are views of the ergonomic hood 1 having ergonomic pads 5 with assembly tabs 6 having holes 7 and a sleeve. When the bend 15 of the hook bar is folded over the guide 26 of the sliding anchor base 4 and the hook bar is going through guide 23, the sleeve 8 of the ergonomic hood 1 is slid into position over guide 26. The ergonomic hood then slides over the triangular bends on the hook bar. The tabs 6 of the ergonomic hood are inserted into three sided gussets 10 of the hook bar 2 with the holes 7 and 11 being aligned. The torsion spring 3 is then slid under the ergonomic hood and the stabs 18 of the torsion spring are inserted into holes 7 and 11 thus securing the ergonomic hood to the hook bar. The hood assembly is now in place.

Figure 4:
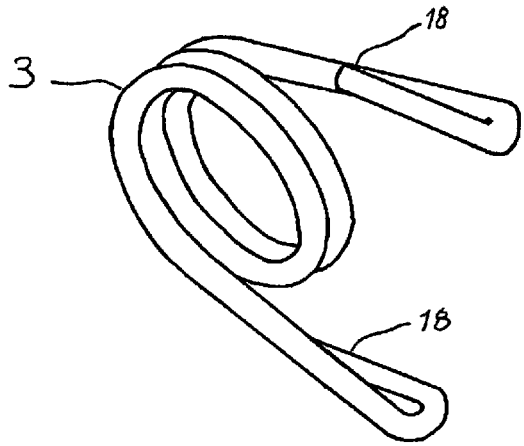
FIGS. 4-4C are views of the torsion spring.
Figure 4A:
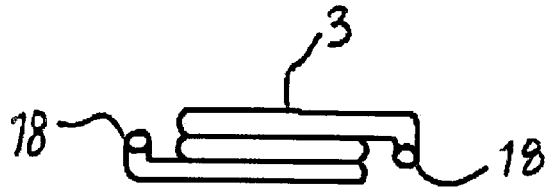
Figure 4B:
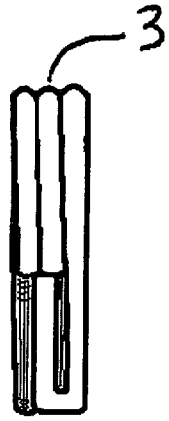
Figure 4C:
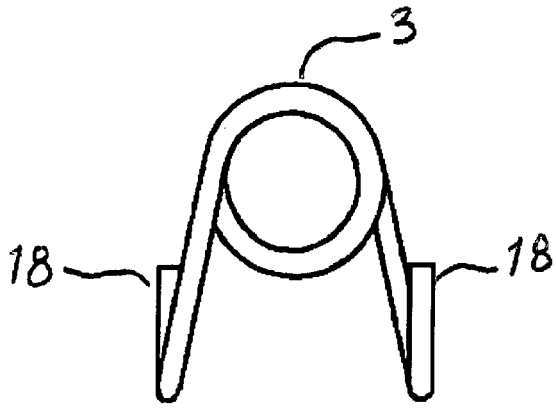

FIGS. 4-4C are views of the torsion spring 3 having stabs 18. The torsion spring 3 slides under the ergonomic hood 1 and the stabs 18 slides into the hook bar gusset holes 11 and the ergonomic hood tabs holes 7. This secures the ergonomic hood 1 to the hook bar 2.

Figure 5:
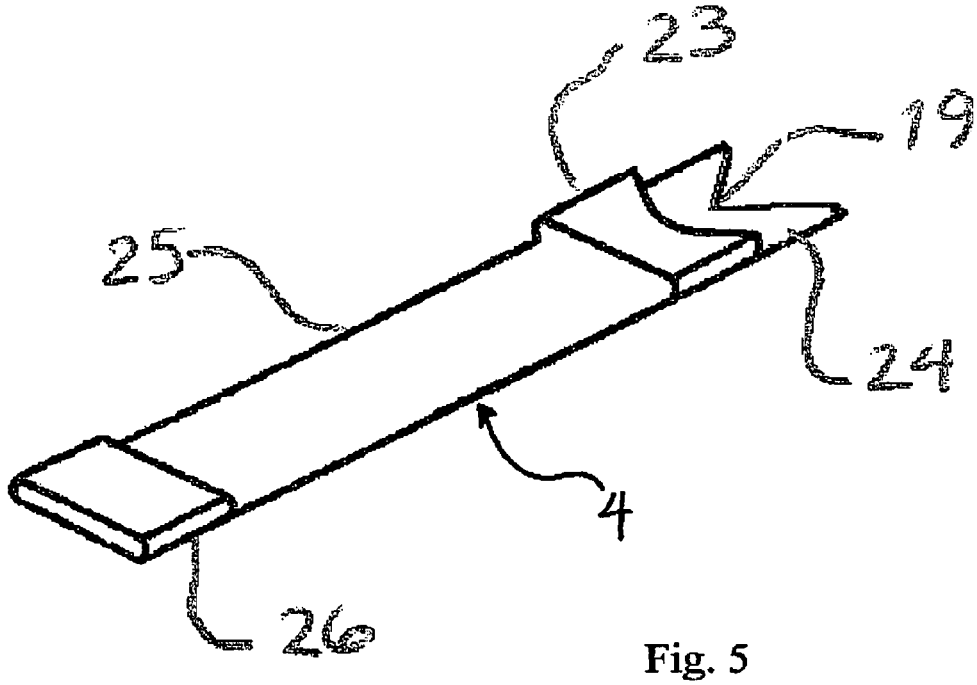
FIGS. 5-5A are views of the sliding anchor base.
Figure 5A:
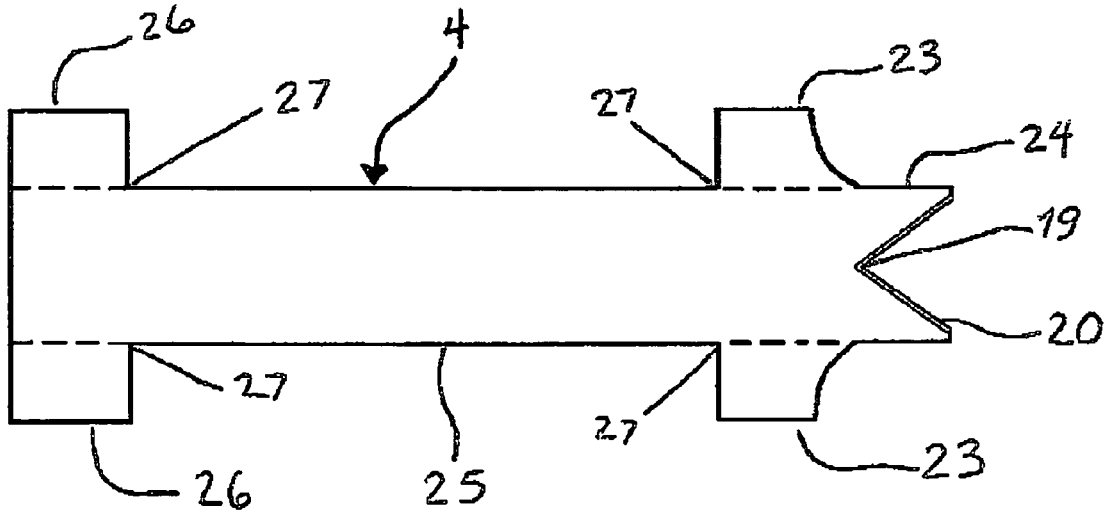

FIGS. 5 and 5A illustrate the sliding anchor base 4. The anchor base guides 23 and 26 maybe integral or maybe formed by tabs 23 and 26 folded at fold lines 27 as shown in FIG. 5A. The sliding anchor base 4 can be fabricated of, non limiting example, nylon or some other tough flexible plastics.

Spring steel is good to use also, along with the hook bar 2. The flex shaft 25 bends and allows the hook latch 17 to be used in odd angles. The front guide 23 has a curved radius which allows the sliding anchor base flat extension 24 and hook bar latch 17 to go under and past the diameter of washers and the heads of bolts (round or hex) to attach to the threads of bolts or screws. The V-cut 19 is the wedge of the sliding anchor base that when coupled with the hook latch 17, is closed onto a screw or bolt, hook latch 17 and V-cut 19 creates a three point contact with the bolt. The sliding anchor base 4 edge 20 is an edge which when hook latch 17 and V-cut 19 come together on a bolt or screw, the sliding anchor base edge 20 slides into the threads thus locking the bolt or screw in place. With the pressure being applied to the bolt by the torsion spring 3, it will hold most bolts and screws being assembled in place without slipping.

I claim:

1. A tool for holding fasteners comprising:

a sliding anchor base having a V-cut notch at a front end, a front guide proximal said V-cut notch and a rear guide;

a hook bar having a hook latch at a front end and defining a triangular shape rear portion formed by a plurality of bends including a first bend, a top bend, a third bend and a last bend folded over towards the third bend for supporting said rear guide, the triangular shaped rear portion including gussets having holes;

a hood having a complementary triangular shape defining a top bend and two sides placed over said triangular shaped rear portion, the hood having pads on the exterior of said sides and including a sleeve covering said last bend and said rear guide, the hood further including gussets having holes; and a torsion spring securing said hood to said hook bar via said gussets and holes; wherein when pressure is applied to said hood the sliding anchor base slides backward against the biasing of said spring opening the notch relative to the hook latch for receiving a fastener and when the pressure is released said spring closes the notch into the hook latch securing said fastener.

2. The tool as set forth in claim 1, wherein said spring has stabs sliding into said holes of said gussets securing the hood and the hook bar.

* * * * *